US005863386A

United States Patent [19]

Vuorinen et al.

[11] Patent Number: 5,863,386

[45] Date of Patent: Jan. 26, 1999

[54] METHOD AND DEVICE FOR WASHING THE DRYING WIRE IN A PAPER OR BOARD MACHINE

[75] Inventors: Vesa Vuorinen, Turku; Iikka Eivola, Merimasku, both of Finland

[73] Assignee: Valmet Corporation, Helsinki, Finland

[21] Appl. No.: 808,056

[22] Filed: Feb. 28, 1997

[30] Foreign Application Priority Data

Jun. 29, 1995 [FI] Finland ..... 953226

[51] Int. Cl.[6] ..... D21F 7/00; D21F 1/32

[52] U.S. Cl. ..... 162/199; 34/85; 34/117; 162/275

[58] Field of Search ..... 162/272, 274, 162/275, 199; 34/85, 117, 120

[56] References Cited

U.S. PATENT DOCUMENTS

| | | | |
|---|---|---|---|
| 3,910,815 | 10/1975 | Shelor | 162/199 |
| 4,540,469 | 9/1985 | Lundstrom | 162/199 |
| 5,416,980 | 5/1995 | Ilvespaa | 34/117 |
| 5,664,731 | 9/1997 | Lemetyinen et al. | 239/113 |

FOREIGN PATENT DOCUMENTS

| | | |
|---|---|---|
| 60045 | 3/1979 | Finland . |
| 67593 | 11/1980 | Finland . |
| 4233910 | 4/1993 | Germany . |
| 4419540 | 1/1995 | Germany . |

OTHER PUBLICATIONS

Albany International "Paper Machine Felt and Fabrics" pp. 135–13, 1976.

*Primary Examiner*—Karen M. Hastings
*Attorney, Agent, or Firm*—Steinberg & Raskin, P.C.

[57] ABSTRACT

A method and device for washing a drying wire in a dryer group in a dryer section of a paper or board machine in which the drying wire is guided by drying cylinders, reversing rolls and guide rolls. A liquid jet is directed at the drying wire at a location after a first one of the drying cylinders in the dryer group and before a last one of the drying cylinders in the dryer group and/or a location on a downward run of the drying wire from one of the drying cylinders. The washing device includes a spray device for providing the liquid jet and possibly an air blow device for blowing air at the drying wire after the liquid jet in order to dry the drying wire.

21 Claims, 3 Drawing Sheets

METHOD AND DEVICE FOR WASHING THE DRYING WIRE IN A PAPER OR BOARD MACHINE

CROSS-REFERENCE TO RELATED APPLICATIONS

This application is a continuation of International Application PCT/FI96/00366 with an international filing date of Jun. 25, 1996.

FIELD OF THE INVENTION

The present invention relates to a method for washing a drying wire in a paper or board machine in which the drying wire is washed and/or dried by means of a liquid and/or air jet when the drying wire runs in a dryer group in the dryer section of a paper machine while guided by drying cylinders, reversing rolls or equivalent and by guide rolls.

Further, the invention relates to a device for affecting a drying wire in a paper or board machine which is situated in a dryer group in the dryer section in the paper machine and which comprises washing means for producing a liquid jet so as to wash the drying wire and/or means for producing an air jet so as to dry the drying wire.

BACKGROUND OF THE INVENTION

As known in the prior art, in multi-cylinder dryers in paper machines, twin-wire draw and/or single-wire draw are/is employed. In twin-wire draw, the groups of drying cylinders include two wires which press the web, one from above and the other one from below, against the heated cylinder faces. Between the rows of drying cylinders, which are usually horizontal rows, the web has free and unsupported draws which are susceptible to fluttering which may result in web breaks, in particular since the web is still relatively moist and, therefore, has a low strength. For this reason, recently, increasing use has been made of the single-wire draw in which there is only one drying wire in each group of drying cylinders, the web running on the support of this wire through the entire group so that the drying wire presses the web on the drying cylinders against heated cylinder faces and the web remains at the side of the outside curve on the reversing cylinders or rolls arranged between the drying cylinders. Thus, in single-wire draw, the drying cylinders are situated outside the wire loop and the reversing cylinders or rolls are situated inside the wire loop. As is well known, in the dryer sections in paper machines, both dryer groups with single-wire draw and dryer groups with twin-wire draw are frequently employed.

The properties required from the drying wires, which are usually made of textile fabric, are different depending on the mode of operation concerned, i.e., single-wire or twin-wire draw.

Accordingly, in single-wire draw, the function of the wire is to support the paper web as a so-called "closed draw". Also, the wire supports the paper against the face of the drying cylinder. In order that the paper is kept in contact with the wire in single-wire draw, various grooved and/or suction rolls are often used as well as blow-suction boxes which produce a vacuum between the cylinders and rolls, such as the stabilizers marketed by the current assignee under the trademark "Uno-Run".

Owing to the above, a permeability within certain limits is required from the wire. When a new wire is acquired for use in the paper machine, it is possible to choose the permeability, but it is often problematic to make the permeability remain within certain limits, because the wire is contaminated during operation.

Since the mechanical service life of a wire is long (about one year), the wire is expensive, and the replacement of the wire always requires a standstill, various wire washing devices are used in order to maintain the permeability of the wire within the desired operating parameters.

In prior art applications, the washing devices are placed on a free, so-called returning portion of the wire, i.e., that portion which usually starts at an upward run of the drying wire after the last drying cylinder or reversing roll or guide roll to the first drying cylinder or reversing roll or guide roll at the beginning of the dryer group. For this reason, the washing liquid can spread over a wide area onto the machine, in which case a wide area can be contaminated and become wet by the effect of splashing, and the washing device can be employed at a very low running speed of the machine only.

Moreover, the prior art wire washing devices wash just a part of the wire width at a time. Also, frequently the spacing/oscillation of the nozzles in the washing device is so slow that the device would have to be operated in normal paper running, which is difficult to arrange because of the splashing of liquid.

In twin-wire draw, besides providing adequate support for the paper web on the cylinders, a function of the wire is to take care of the ventilation of the so-called pocket spaces, i.e., to carry away the evaporating liquid out of the closed space formed by the paper and the wire. As is the case also in single-wire draw, this function requires that the permeability of the wire is retained within certain operating parameters as long as possible. The problems of the prior art washing devices in connection with twin-wire draw are the same as in connection with single-wire draw applications. With respect to different devices for washing of drying wires and related arrangements, which are in themselves known, reference can be made, for example, to Finnish Patents No. 67593 and 60045, and U.S. Pat. No. 3,910,815 (incorporated by reference herein).

OBJECTS AND SUMMARY OF THE INVENTION

Accordingly, it is an object of the present invention to provide a system for washing drying wires that avoids the problems discussed above.

It is another object of the present invention to provide a new and improved method and apparatus for washing a drying wire in a dryer section of a paper machine.

In view of achieving the objects stated above and others, in the method in accordance with the invention, a washing liquid jet is applied to the drying wire when the drying wire runs substantially downward from a drying cylinder in the dryer group, any drying cylinder from the first drying cylinder to the last drying cylinder, and/or when the drying wire runs toward the next reversing roll or equivalent or toward a guide roll, in other words, at a location between the first drying cylinder and the last drying cylinder or possibly immediately preceding the first drying cylinder.

The washing device in accordance with the invention is arranged in the dryer section in the paper machine in the vicinity of the drying wire so that its incorporated means for producing a liquid jet direct the liquid jet toward the drying wire when the wire runs substantially downward from a drying cylinder and/or substantially before the drying wire runs onto the next reversing roll or guide roll or equivalent.

One of the more important features of the arrangement of the present invention is, for example, the location of the washing device so that the washing liquid can be separated from the wire as quickly and efficiently as possible, i.e., when the device is placed in a location in which the wire runs downward (and thus gravity aids in the separation and removal of the washing liquid) and in which the centrifugal force produced by a reversing roll or equivalent can be utilized. Further, the device is preferably placed as near the well of the machine as possible, in which case, possible splashes, if any, do not wet the machine over a wide area or do not wet the machine at all.

According to the invention, the washing device can operate in combination with a runnability aiding or enhancing device, air-conditioning device or any other device (for example a doctor). The device may also be placed on the rising side of the wire if lack of space or any other reason requires that.

According to the invention, in applications with single-wire draw, the washing device is placed so that, preferably, the run of the wire at the time at which the washing liquid is applied to the wire is downward toward the bottom, i.e., toward the floor of the machine hall and/or basement, and the centrifugal force of the revolving reversing roll facilitates the separation of the liquid from the wire. The washing device is preferably placed in the beginning of the drying group, whereby the time of drying of the wire on the cylinders is maximized.

The dimensioning and the construction of the washing device are arranged such that, besides at a crawling speed, the device can expressly also be used at a normal running speed of the paper machine when running without paper. In such a case, it is possible to use short break standstills for washing, and the washing area of the device is selected to cover the entire width of the wire or as oscillating with a certain spacing over the entire wire width.

The best result is often obtained when the washing of the wire takes place from the paper side, i.e., the washing jet is directed at the side of the wire which contacts the web during operation of the dryer group for drying the web. In such a case, the washing device is preferably placed below a cylinder between an adjacent pair of reversing rolls. In this location, there is typically a doctor of the cylinder and/or an air-conditioning pipe that blows fresh air to the space underneath the machine, or equivalent. The washing device can be constructed as a separate device or by attaching it to the doctor/air-conditioning pipe, or by constructing it in an interior of one of these components. In such a case, for example oscillating direct pressure washing can be used. Moreover, cleaning and/or drying of the drying wire by means of compressed air can be placed in this area.

The location most suitable for washing the rear side of the drying wire, i.e., that side which does not contact the web during operation of the dryer group for drying the web, is the portions between a cylinder and a roll. Typically, the portion arriving from a cylinder onto a roll is used, because in such a case, e.g., the following advantages are obtained:

a. the wire pumps the liquid down;

b. the centrifugal force of the revolving roll facilitates the removal of the liquid downward right on the first roll;

c. the nip formed by the wire and by the roll forces any liquid that remains at the side of the device to pass through the wire (the washing can be intensified or the removal of the liquid out of the wire be promoted by means of blowing of air, by blowing air before the nip, into the nip, or to the opposite (i.e., rising) side);

d. this mode of washing can also be used for cleaning a grooved or perforated roll, or for cleaning a grooved or perforated roll it is possible to use a separate device provided for the rolls.

In a suitable location of the washing device, there is often a blow-suction box that stabilizes the run of the web. In such a case, the washing device may be constructed in connection with it either separately or as attached to it or as a built-in module. The blowing air generated by the blow-suction boxes can be used for the nip blowing.

If the geometry of the machine is so congested that the washing device cannot be placed near the nip of the roll, the device is placed higher at a suitable location before the wire meets the cylinder.

Various combinations of the paper-side and rear-side wire washing and drying devices described above are also included in the scope of the present invention.

In groups with twin-wire draw, the preferred location of the device for washing the upper wire is at the beginning of the drying group before the first upper cylinder or at the end of the dryer group after the last cylinder when the last cylinder is an upper cylinder. If there is a stabilizer or equivalent in this location, the washer is constructed by attaching the washer to it or by constructing them together.

In order to obtain economies of time, the washing device in each dryer group can be operated at the same time. On the other hand, in order to minimize the cost of equipment, it is possible to wash the wires one after the other.

Also, it is possible to make the operation of the equipment fully automatic, and, if necessary, the device can be connected to the logic/control system of the machine. Further, it is possible to arrange the desired timing of the washing process of each individual wire, i.e., the sequence and the duration of, for example, the stages of pre-washing—chemical washing—rinsing. Chemicals can be included in the washing liquid, or the chemicals can be applied directly to the wire by means of a separate device. Compressed-air blowing can be used as an aid for the liquid and/or for wire drying.

In the following, the invention will be described in more detail with reference to the figures in the accompanying drawing. However, the invention is not strictly confined to the details in the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
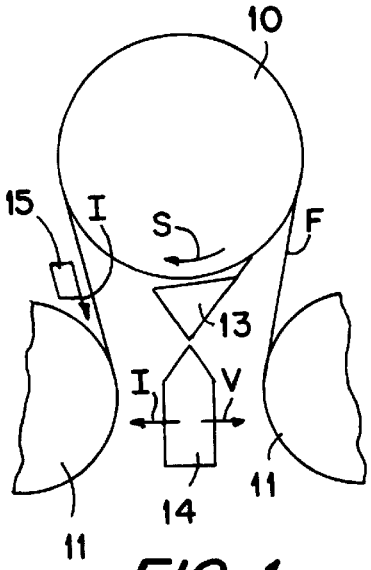
FIGS. 1 and 2 are schematic illustrations of exemplifying embodiments of a drying wire washing arrangement in accordance with the invention, wherein the washing device in accordance with the invention is placed in connection with an air-conditioning device.

Referring to the accompanying drawings wherein the same reference numerals refer to the same or similar elements, FIG. 1 shows an exemplifying embodiment of the invention in a dryer group with normal single-wire draw in the dryer section of a paper machine wherein a wire F runs from a reversing roll or equivalent 11 onto a drying cylinder 10 and further onto a subsequently arranged reversing roll 11. The sense or direction of rotation of the drying cylinder 10 is denoted by reference arrow S. The situation shown in FIG. 1 is taken during the washing stage, in which a paper web does not run on support of the wire F. However, it should be recognized that the drying wire can be washed in accordance with the invention while the web is being carried thereby. In the opening nip of the first reversing roll 11, a blow box 15 is placed and arranged to blow a stream of compressed air I into the opening nip defined between the wire F and the initial reversing roll 11. Below the drying cylinder 10, in connection with a body of a doctor blade 13, a washing device 14 is placed and is arranged to spray pressurized liquid (arrow V) toward the wire F that runs over the subsequently arranged reversing roll 11, and to blow air (arrow I) toward the wire F that runs over the initial reversing roll 11.

Figure 2:
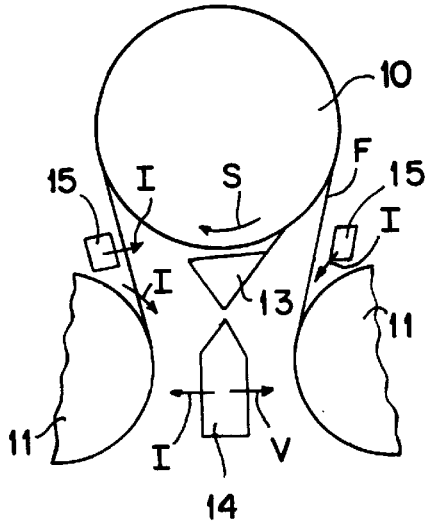

The exemplifying embodiment shown in FIG. 2 is similar to that shown in FIG. 1, except that in this exemplifying embodiment, out of the blow box 15 placed in the opening nip, besides the blowing of air into the opening nip, air is also blown in a perpendicular direction relative to and against the wire F (arrows I). The washing device 14 placed in connection with the body of the doctor blade 13 sprays liquid in the manner indicated by the arrow V toward the wire F that runs over the subsequently arranged reversing roll 11 and air in the manner indicated by the arrow I toward the wire F that runs over the preceding, initial reversing roll 11. A second blow box 15 is placed in connection with the subsequently arranged reversing roll 11, by means of which second blow box air is blown into the closing nip. The body of the doctor blade 13 may be used for directing air for ventilation purposes, i.e., as an air-conditioning device.

Figure 3:
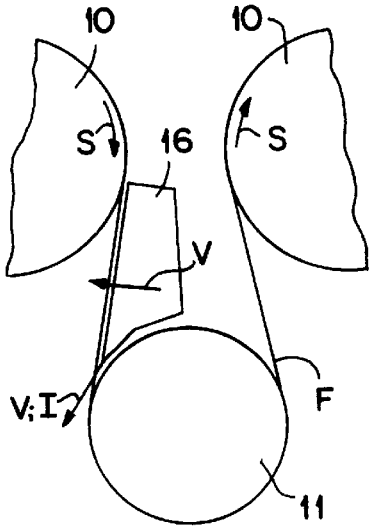
FIGS. 3, 4 and 5 are schematic illustrations of exemplifying embodiments of an arrangement in accordance with the invention wherein the washing device in accordance with the invention is placed in connection with a blow-suction box.

In the exemplifying embodiment shown in FIG. 3, likewise, a dryer group is concerned which makes use of normal single-wire draw and in which the drying cylinders are denoted by reference numeral 10 and they revolve in the direction indicated by the arrows S. In this arrangement, the wire F is cleaned from its rear side, and the washing device is combined with a blow-suction box 16. As shown by the arrow V, liquid is sprayed from the combined blow-suction box/washing device toward the wire F on its run from the drying cylinder onto the reversing roll 11 and as shown by the arrows V;I, both liquid and air are spraying into the closing nip at the reversing roll 11.

Figure 4:
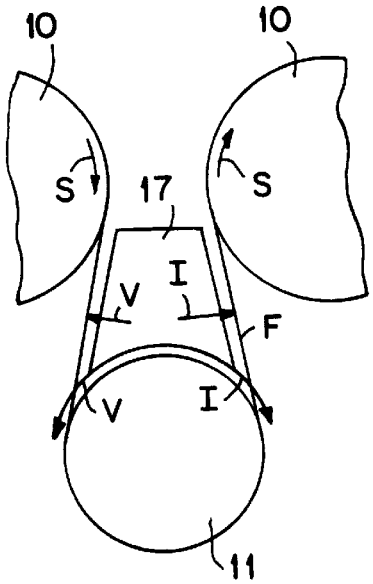

In FIG. 4, an exemplifying embodiment similar to FIG. 3 is shown for washing the rear side of the wire F, wherein the washing device is combined with a blow-suction box 17. Onto the wire arriving on the reversing roll 11, liquid is sprayed in a direction perpendicular to its run from the drying cylinder 10 onto the reversing roll 11 and into the nip closing at the reversing roll 11. From the combined blow-suction box/washing device 17, air is blown into the nip that opens from the reversing roll 11 as well as perpendicular to the run of the wire F from the reversing roll 11 onto the drying cylinder 10.

Figure 5:
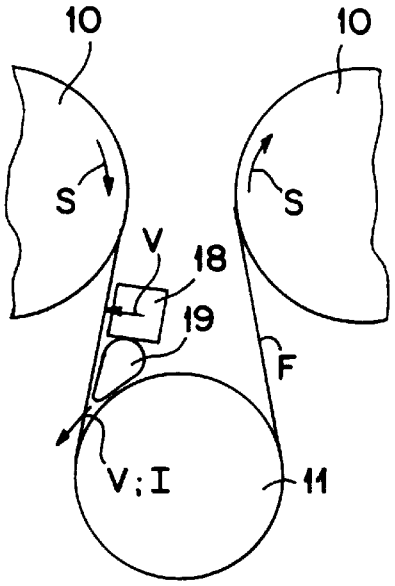

In the exemplifying embodiment shown in FIG. 5, washing of the rear side of the wire F is concerned, and in this arrangement the washing device 18 has been arranged as a separate unit but in connection with the blow-suction box 19. The pressure-liquid jets are denoted by arrows V, and the air blowing stream is denoted by the arrow I.

Figure 6:
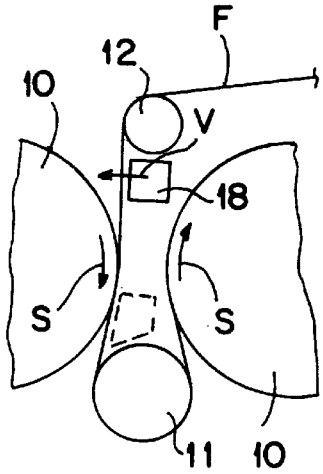
FIG. 6 is a schematic illustration of an exemplifying embodiment wherein the machine has a compact geometry, in which case the washing device in accordance with the invention is placed in a location before the wire reaches contact with the cylinder.

The exemplifying embodiment shown in FIG. 6 is related to a dryer group with a compact geometry in the dryer section of a paper machine, in which case the nip of the roll cannot be used as the location of the washing device, but the device is placed at a higher location before the wire F reaches contact with the cylinder. From the washing device 18, pressurized liquid V is blown and directed toward the wire F on its run from the guide roll 12 to the reversing roll 11.

Figure 7:
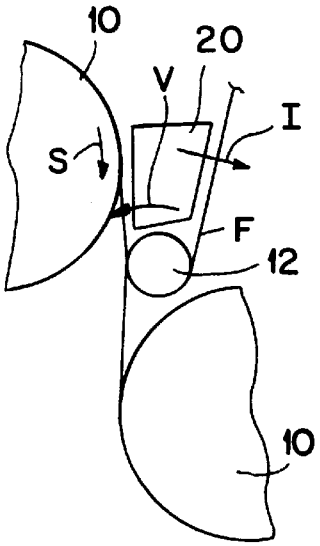
FIG. 7 is a schematic illustration of an exemplifying embodiment in which, in a dryer group that makes use of twin-wire draw, the washing device in accordance with the invention is arranged in connection with the upper wire on the wire portion after the last drying cylinder in the group.

FIG. 7 shows an exemplifying embodiment for a group with twin-wire draw in the dryer section of a paper machine, wherein the washing device is placed after the last upper cylinder 10 in the group, where the washing device is constructed as a device 20 combined with a stabilizer device. The pressure-liquid jet is denoted by reference arrow V and the air jet is denoted by reference arrow I.

Figure 8:
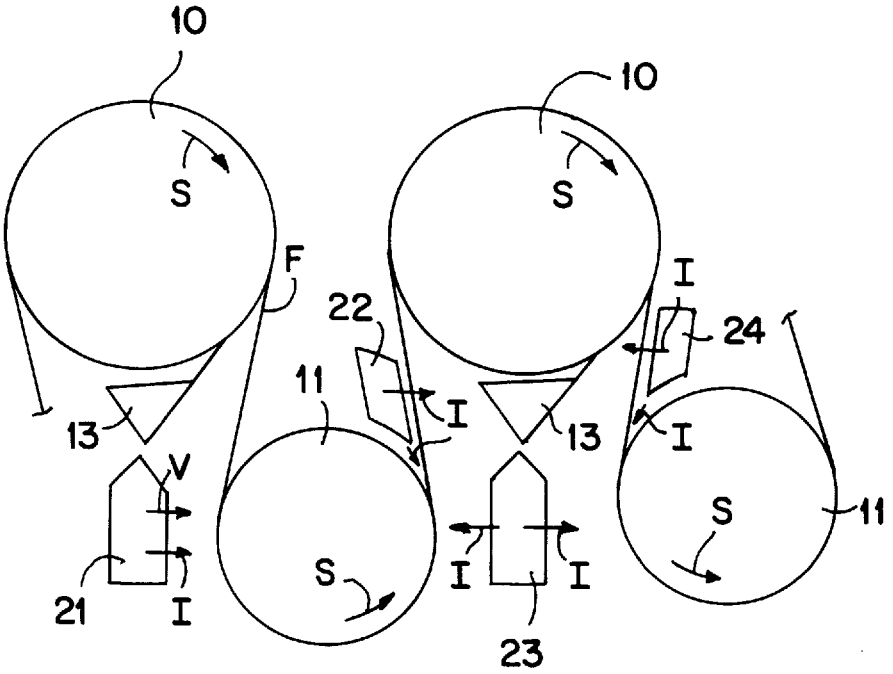
FIG. 8 is a schematic illustration of an exemplifying embodiment in which, in a dryer group that makes use of single-wire draw, air drying has been employed in addition to the washing device.

In the exemplifying embodiment shown in FIG. 8, the wire F washing device 21 is arranged below an upper cylinder 10 in a dryer group that uses single-wire draw, underneath the body of the doctor blade 13, and by means of the washing device 21, liquid is sprayed in the manner indicated by the arrow V toward the wire F on its run onto the reversing roll 11. The washing device 21 is also provided with blowing of air, which is indicated by the arrow I, which blowing of air I dries the wire F. FIG. 8 also shows alternative or additional drying devices 22,23,24, by whose means air is blown, as is indicated by the arrows I, toward the wire F in order to dry the wire. The drying is preferably arranged as close as possible to the location at which the wire is subjected to liquid washing, denoted by arrow V, but the entire gaps between the cylinders and rolls in the dryer group are available for the location of the drying devices.

Figure 9:
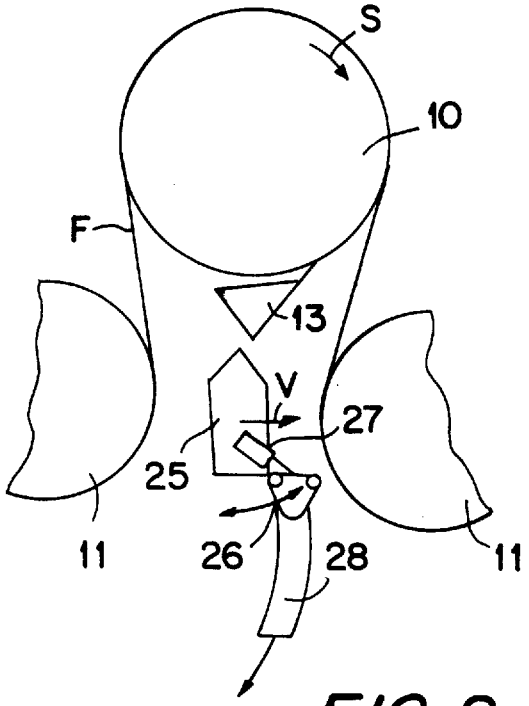
FIG. 9 is a schematic illustration of an exemplifying embodiment in which a water collecting trough has been provided in connection with the washing device.

FIG. 9 is a schematic illustration of an exemplifying embodiment in which a water collecting trough 26 is arranged in connection with the wire F washing device 25, into which trough the major part of the washing liquid that was used can be passed and out of which trough the water can be passed further to the desired drain pipe 28, such as the sewer. The water collecting trough 26 can be shifted for the time of normal running away from the opening between the washing device 25 and the wire F, for example, by means of a pneumatic cylinder 27 or an equivalent actuator.

The examples provided above are not meant to be exclusive. Many other variations of the present invention would be obvious to those skilled in the art, and are contemplated to be within the scope of the appended claims.

We claim:

1. A method for washing a drying wire in a single-wire draw dryer group in a dryer section of a paper or board machine, the dryer group comprising a plurality of drying cylinders, reversing rolls and guide rolls, the drying wire being guided by the drying cylinders, reversing rolls and guide rolls, comprising the steps of:

arranging a washing device underneath one of the drying cylinders and alongside at least one of the reversing rolls, and directing a liquid jet from the washing device at the drying wire at a location after a first one of the drying cylinders in the dryer group, before a last one of the drying cylinders in the dryer group and on a downward run of the drying wire from said one of the drying cylinders.

2. The method of claim 1, wherein the liquid jet is directed at a paper side of the drying wire which contacts the web during operation of the dryer group for drying the web.

3. The method of claim 1, wherein the liquid jet is directed at a rear side of the drying wire which does not contact the web during operation of the dryer group for drying the web.

4. The method of claim 1, further comprising the step of:

guiding the drying wire through the dryer group without a web while the liquid jet is directed at the drying wire.

5. The method of claim 1, further comprising the step of:

guiding the drying wire though the dryer group at a crawling speed while the liquid jet is directed at the drying wire.

6. The method of claim 1, further comprising the step of:

guiding the drying wire though the dryer group at a normal operating speed while the liquid jet is directed at the drying wire.

7. The method of claim 1, wherein the liquid jet is directed at the drying wire between said one of the drying cylinders and one of the reversing rolls immediately following said one of the drying cylinders in the running direction of the drying wire.

8. A device in a single-wire draw dryer group of a dryer section of a paper or board machine for cleaning a drying wire, the dryer group comprising a plurality of drying cylinders and reversing rolls over which the drying wire is guided, comprising spray means for directing a liquid jet at the drying wire to wash the drying wire, said spray means being arranged underneath one of the drying cylinders and alongside at least one of the reversing rolls, in opposed relationship to the drying wire and such that the liquid jet is directed toward the drying wire at a location after a first one of the drying cylinders in the dryer group, before a last one of the drying cylinders in the dryer group and on a downward run of the drying wire from said one of the drying cylinders.

9. The device of claim 8, further comprising an air-conditioning device arranged underneath said one of the drying cylinders in the vicinity of said spray means.

10. The device of claim 8, further comprising blow means for directing an air jet at the drying wire to dry the drying wire after the liquid jet has been applied to the drying wire.

11. The device of claim 10, wherein said blow means are separate from said spray means and arranged downstream of said spray means in a running direction of the drying wire.

12. The device of claim 8, further comprising a blow-suction box for directing air at the drying wire, said spray means being constructed and incorporated as a single unit together with said blow-suction box.

13. The device of claim 8, further comprising a blow-suction box for directing air at the drying wire, said spray means being attached to said blow-suction box.

14. The device of claim 8, further comprising a doctor engaging with said one of said drying cylinders, said spray means being arranged in the vicinity of said doctor.

15. A method for washing a drying wire in a single-wire draw dryer group in a dryer section of a paper or board machine, the dryer group comprising a plurality of drying cylinders, reversing rolls and guide rolls, the drying wire being guided by the drying cylinders, reversing rolls and guide rolls, comprising the steps of:

arranging a washing device above one of the reversing rolls and between an adjacent pair of the drying cylinders, and directing a liquid jet from the washing device at the drying wire at a location after a first one of the drying cylinders in the dryer group, before a last one of the drying cylinders in the dryer group and on a downward run of the drying wire to said one of said reversing rolls.

16. The method of claim 15, wherein the liquid jet is directed at a rear side of the drying wire which does not contact the web during operation of the dryer group for drying the web.

17. The method of claim 15, further comprising the step of directing air at the drying wire from a blow-suction box, said washing device being constructed and incorporated as a single unit together with said blow-suction box.

18. The method of claim 15, further comprising the step of directing air at the drying wire from a blow-suction box, said washing device being attached to said blow-suction box.

19. A device in a single-wire draw dryer group of a dryer section of a paper or board machine for cleaning a drying wire, the dryer group comprising a plurality of drying cylinders and reversing rolls over which the drying wire is guided, comprising spray means for directing a liquid jet at the drying wire to wash the drying wire, said spray means being arranged above one of the reversing rolls and between an adjacent pair of the drying cylinders, in opposed relationship to the drying wire and such that the liquid jet is directed toward the drying wire at a location after a first one of the drying cylinders in the dryer group, before a last one of the drying cylinders in the dryer group and on a downward run of the drying wire to said one of said reversing rolls.

20. The device of claim 19, further comprising a blow-suction box for directing air at the drying wire, said spray means being constructed and incorporated as a single unit together with said blow-suction box.

21. The device of claim 19, further comprising a blow-suction box for directing air at the drying wire, said spray means being attached to said blow-suction box.

* * * * *